US006682182B2

(12) United States Patent
Jeanmaire et al.

(10) Patent No.: US 6,682,182 B2
(45) Date of Patent: Jan. 27, 2004

(54) CONTINUOUS INK JET PRINTING WITH IMPROVED DROP FORMATION

(75) Inventors: David L. Jeanmaire, Brockport, NY (US); James M. Chwalek, Pittsford, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 9 days.

(21) Appl. No.: 10/120,023

(22) Filed: Apr. 10, 2002

(65) Prior Publication Data

US 2003/0193551 A1 Oct. 16, 2003

(51) Int. Cl.[7] ..... B41J 2/07
(52) U.S. Cl. ..... 347/74
(58) Field of Search ..... 347/73, 74–77, 347/80–82, 20, 6

(56) References Cited

U.S. PATENT DOCUMENTS

| | | | | |
|---|---|---|---|---|
| 3,709,432 A | | 1/1973 | Robertson | 239/4 |
| 4,190,844 A | | 2/1980 | Taylor | 347/82 |
| 5,224,843 A | | 7/1993 | vanLintel | 417/413.2 |
| 6,079,821 A | | 6/2000 | Chwalek et al. | 347/82 |
| 6,491,362 B1 | * | 12/2002 | Jeanmaire | 347/15 |
| 6,554,410 B2 | * | 4/2003 | Jeanmaire et al. | 347/77 |

* cited by examiner

*Primary Examiner*—Lamson Nguyen
*Assistant Examiner*—K. Feggins
(74) *Attorney, Agent, or Firm*—Milton S. Sales

(57) ABSTRACT

Imaging apparatus includes a printhead with one or more nozzles, wherein heaters are positioned proximate to the nozzles. Electrical activation of the heaters creates ink droplets having a plurality of volumes. The use of higher-energy pulses in the portion of the waveform of heater activation associated with the formation of small drops results in more constant relative drop velocities and consequently, improved image quality. The printing apparatus also contains a droplet deflector having a gas source positioned at an angle with respect to the stream of droplets thereby separating ink droplets having one of the plurality of volumes from ink droplets having another of the plurality of volumes. An ink guttering structure is provided for capturing one range of ink-drop volumes, while allowing another volume range to strike an image receiver.

15 Claims, 4 Drawing Sheets

CONTINUOUS INK JET PRINTING WITH IMPROVED DROP FORMATION

CROSS REFERENCE TO RELATED APPLICATIONS

Reference is made to commonly assigned, co-pending U.S. patent applications Ser. No. 09/751,232 and Ser. No. 09/750,946 filed Dec. 28, 2000 in the names of David L. Jeanmaire et al., and Ser. No. 09/910,097 filed Jul. 20, 2001 in the name of David L. Jeanmaire et al.

FIELD OF THE INVENTION

This invention relates generally to the field of digitally controlled printing devices, and in particular to continuous ink jet printers wherein a liquid ink stream breaks into droplets, some of which are selectively deflected.

BACKGROUND OF THE INVENTION

Traditionally, digitally controlled color printing capability is accomplished by one of two technologies. The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With piezoelectric actuators, an electric field is applied to a piezoelectric material possessing properties that create a mechanical stress in the material causing an ink droplet to be expelled. Piezoelectric actuators, such as that disclosed in U.S. Pat. No. 5,224,843, issued to vanLintel on Jul. 6, 1993, have a piezoelectric crystal in an ink fluid channel that flexes when an electric current flows through it forcing an ink droplet out of a nozzle. In a bubble jet printer, ink in a channel of a printhead is heated, creating a bubble which increases internal pressure ejecting an ink droplet out of a nozzle of the printhead. The bubble then collapses as the heating element cools, and the resulting vacuum draws fluid from a reservoir to replace ink that was ejected from the nozzle.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When print is desired, the ink droplets are not deflected and allowed to strike a print media. Alternatively, deflected ink droplets may be allowed to strike the print media, while non-deflected ink droplets are collected in the ink capturing mechanism.

Typically, continuous ink jet printing devices are faster than drop-on-demand devices and produce higher quality printed images and graphics. However, each color printed requires an individual droplet formation, deflection, and capturing system.

Conventional continuous ink jet printers utilize electrostatic charging devices and deflector plates, they require many components and large spatial volumes in which to operate. This results in continuous ink jet printheads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member. While this method does not rely on electrostatic means to affect the trajectory of droplets it does rely on the precise control of the break off points of the filaments and the placement of the air flow intermediate to these break off points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "on/off" or an "open/closed" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount a nozzle is open depending on a varying electrical signal received the central control unit. This oscillates printed ink droplets so that characters may be printed one character at a time. If only the first pneumatic deflector is used, characters are created one line at a time, being built up by repeated traverses of the printhead.

While this method does not rely on electrostatic means to affect the trajectory of droplets it does rely on the precise control and timing of the first ("open/closed") pneumatic deflector to create printed and non-printed ink droplets. Such a system is difficult to manufacture and accurately control, and unfortunately, such printing methods require a separate pneumatic deflector for each nozzle in the printhead. Since such deflectors are relatively slow in action, the printing speed is low relative to current, commercial ink jet systems. Furthermore, the physical separation or amount of discrimination between the two droplet paths is erratic due to the precise timing requirements increasing the difficulty of controlling printed and non-printed ink droplets resulting in poor ink droplet trajectory control.

Additionally, using two pneumatic deflectors complicates construction of the printhead and requires more components. The additional components and complicated structure require large spatial volumes between the printhead and the media, increasing the ink droplet trajectory distance. Increasing the distance of the droplet trajectory decreases droplet placement accuracy and affects the print image quality. Again, there is a need to minimize the distance the droplet must travel before striking the print media in order to insure high quality images. Pneumatic operation requiring the air flows to be turned on and off is necessarily slow in that an inordinate amount of time is needed to perform the mechanical actuation as well as time associated with the settling any transients in the air flow.

U.S. Pat. No. 6,079,821, issued to Chwalek et al. on Jun. 27, 2000, discloses a continuous ink jet printer that uses actuation of asymmetric heaters to create individual ink droplets from a filament of working fluid and deflect those ink droplets. A printhead includes a pressurized ink source and an asymmetric heater operable to form printed ink droplets and non-printed ink droplets. Printed ink droplets flow along a printed ink droplet path ultimately striking a print media, while non-printed ink droplets flow along a non-printed ink droplet path ultimately striking a catcher surface. Non-printed ink droplets are recycled or disposed of through an ink removal channel formed in the catcher. While the ink jet printer disclosed in Chwalek et al. works extremely well for its intended purpose, using a heater to create and deflect ink droplets increases the energy and power requirements of this device.

U.S. patent application Ser. Nos. 09/750,946 and 09/751,232 disclose the use of an air stream to separate ink drops of a plurality of volumes into spatially differing trajectories. Non-imaging droplets, having one grouping of volumes, are not permitted to reach the image receiver, while imaging droplets having a significantly different range of volumes are permitted to make recording marks on the receiver. While printheads employing the invention described in these disclosures work well, there is a certain distance from the printhead that is required for drop formation to be complete. In these printheads, initial jet breakup is caused by temperature changes due to heater activation by electrical pulses. Following the initial fluid breakup, larger drops are created through the coalescence of smaller drops and fluidic strings, and this coalescence distance is a function of fluid and thermal properties (e.g., surface tension, viscosity, thermal conductivity, etc.) as well as the operating conditions such as ink pressure and drop velocity. Generally, the separation airstream cannot be applied to the droplet stream until the desired drop formation has taken place. A method for addressing this problem and improving the drop formation was disclosed in application U.S. Ser. No. 09/910,097, filed Jul. 20, 2001 by Jeanmaire et al., whereby a short pre-pulse of heater activation is used to shorten the droplet coalescence time.

Once the droplets are formed, droplet streams consisting of a plurality of drop sizes transverse the gas separation means on the way to either a ink catcher or the print medium. Unfortunately, some unintended merging of ink droplets may occur due to slightly different droplet velocities in the ink stream containing droplets of differing volumes. Merging of "printing" with other "printing" or "non-printing" droplets while the gas separation force is being applied results in printing droplet paths which are no longer correct. This can either result in misplaced drops on the print medium, drops of incorrect size landing on the print medium, or droplets which fail to reach the print medium.

For this reason, it can be seen that there is a opportunity to provide a modified inkjet printhead and printer of simple construction having simple control of individual ink droplets with more constant relative velocities between droplets of differing volumes. The range over which the gas separation force can be applied can be increased to take advantage of physical designs of gas flow generators which have optimum uniformity characteristics. In this manner, the quality of printing is increased by improving drop placement on the print medium, while retaining the low energy and power consumption advantage of the printing method described above.

SUMMARY OF THE INVENTION

In accordance with a feature of the present invention, an apparatus produces a stream of fluid droplets of at least two types, the droplets of one of the types being of greater fluid volume than the droplets of the other type. A droplet forming mechanism is actuatable by a series of energy pulses to create a series of one or more droplets, the first of the droplets of each series being of the one type, and any droplets subsequent to the first of the droplets of each series being of the other type. A controller applies the series of energy pulses to the droplet forming mechanism such that a pulse associated with droplets of the one type has a predetermined energy and pulses associated with the droplets of the other type have energy substantially greater than the predetermined energy.

The energy of the pulses associated with droplets of the other type is about 5% to about 300% greater than the predetermined energy. Preferably, the energy of the pulses associated with droplets of the other type is between about 10% and about 100% greater than the predetermined energy.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
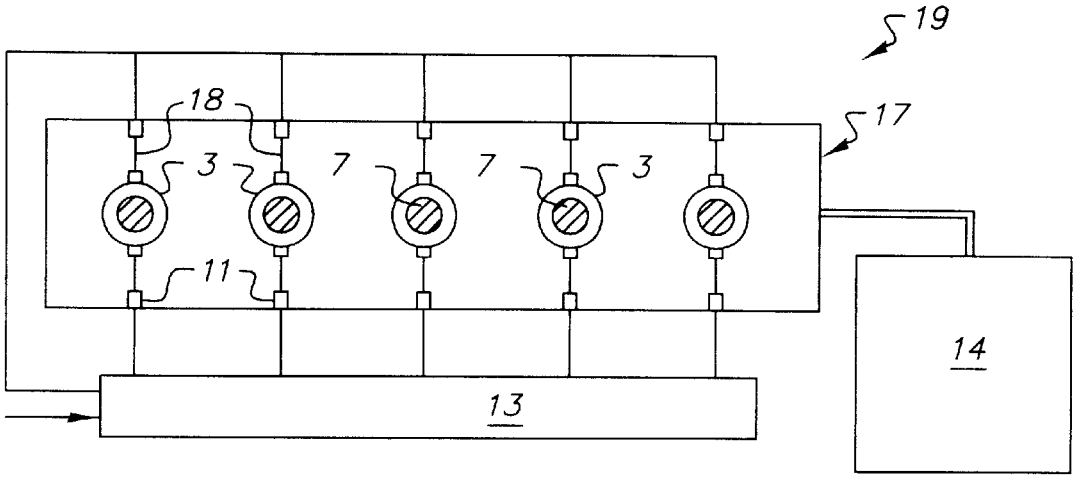
FIG. 1 is a schematic plan view of a printhead made in accordance with a preferred embodiment of the present invention.

FIG. 1 shows an ink droplet forming mechanism 19 of a preferred embodiment of the present invention. Ink droplet forming mechanism 19 includes a printhead 17, at least one ink supply 14, and a controller 13. Although ink droplet forming mechanism 19 is illustrated schematically and not to scale for the sake of clarity, one of ordinary skill in the art will be able to readily determine the specific size and interconnections of the elements of the preferred.

In a preferred embodiment of the present invention, printhead 17 is formed from a semiconductor material (silicon, etc.) using known semiconductor fabrication techniques (CMOS circuit fabrication techniques, micro-electro mechanical structure (MEMS) fabrication techniques, etc.). However, it is specifically contemplated and, therefore within the scope of this disclosure, that printhead 17 may be formed from any materials using any fabrication techniques conventionally known in the art.

Nozzles 7 are in fluid communication with ink supply 14 through an ink passage (not shown) also formed in printhead 17. It is specifically contemplated, therefore within the scope of this disclosure, that printhead 17 may incorporate additional ink supplies in the manner of 14 and corresponding nozzles 7 in order to provide color printing using three or more ink colors. Additionally, black and white or single color printing may be accomplished using a single ink supply 14 and nozzles 7.

A heater 3 is at least partially formed or positioned on printhead 17 around a corresponding nozzle 7. Although heater 3 may be disposed radially away from an edge of corresponding nozzle 7, the heater is preferably disposed close to corresponding nozzle 7 in a concentric manner. In a preferred embodiment, heater 3 is formed in a substantially circular or ring shape. However, it is specifically contemplated, therefore within the scope of this disclosure, that heater 3 may be formed in a partial ring, square, etc. Heater 3 in a preferred embodiment consists principally of an electric resistive heating element electrically connected to electrical contact pads 11 via conductors 18.

Conductors 18 and electrical contact pads 11 may be at least partially formed or positioned on printhead 17 and provide an electrical connection between controller 13 and heater 3. Alternatively, the electrical connection between controller 13 and heater 3 may be accomplished in any well-known manner. Additionally, controller 13 may be a relatively simple device (a power supply for heater 3, etc.) or a relatively complex device (logic controller, programmable microprocessor, etc.) operable to control many components (heater 3, ink droplet forming mechanism 19, etc.) in a desired manner.

Printhead 17 is able to create drops having a plurality of volumes. In the preferred implementation of this invention, smaller drops are used for printing, while larger drops are prevented from striking an image receiver. The creation of large ink drops involves two steps. The first is the activation of heater 3 associated with nozzle 7 with an appropriate waveform to cause a jet of ink fluid to break up into fluidic structures having a plurality of volumes. Secondly, portions of the fluidic structures originating from jet breakup coalesce to form larger drops.

Figure 2:
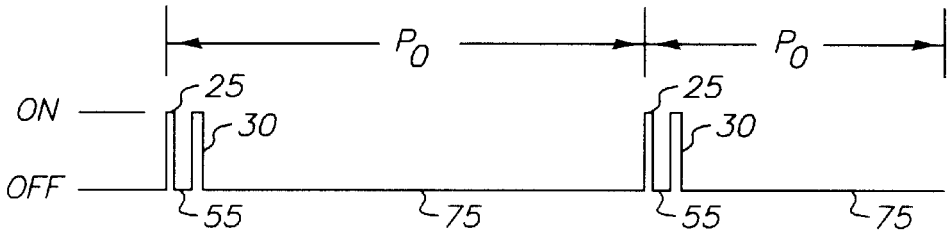
FIGS. 2(*a*)–2(*d*) consists of a series of diagrams illustrating a frequency control of a heater and drop formation.
Figure 2:
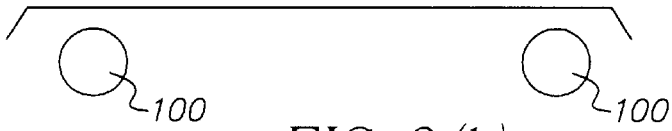
Figure 2:
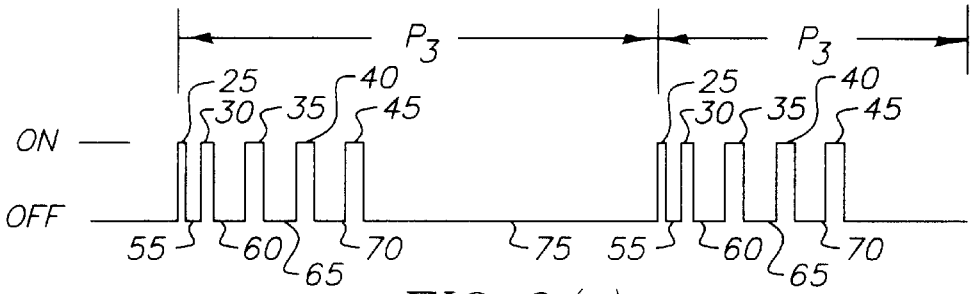
Figure 2:
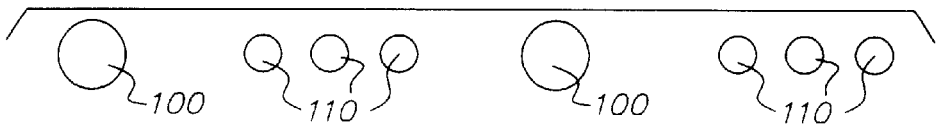

An example is presented here in FIGS. 2(*a*)–2(*d*), representative of an embodiment disclosed by Jeanmaire and Chwalek in U.S. application Ser. No. 09/910,097, of printhead operation with attendant heater activation for a printing implementation using a gas flow separation means. This example focuses on the electrical waveforms of heater activation provided in an implementation to deliver three ink droplets per nozzle to the recording media during the time associated with the printing of a pixel of image data. Two states are presented, a "non-printing" condition (FIGS. 2(*a*) and 2(*b*)), and a "printing" condition (FIGS. 2(*c*) and 2(*d*)). Consider first the "non-printing" state, where a single, large droplet is produced during the time $P_o$ as a result of heater 3 actuation pulse 30 by controller 13 in accordance with the waveform of FIG. 2(*a*). The jet of ink emanating from nozzle 7 is broken up into droplets, some of which coalesce, forming large droplets. The coalescence process is integral to drop formation where larger drop sizes are desired, and is essential to obtaining large ratios in drop volumes between non-printing and printing drops, prior to the application of a separation force due to gas flow. As discussed in U.S. application Ser. No. 09/910,097 (Jeanmaire et al.), an optional pre-pulse 25 facilitates the droplet coalescence process, but does not change either the count or volume of ink droplets formed. Single, large "non-printing" ink droplets 100 resulting from the jetting of ink from nozzle 7, in combination with heater actuation pulse 30 of FIG. 2(*a*), are shown schematically in FIG. 2(*b*) at a distance from the printhead where the desired droplet formation is complete.

The complementary ("printing") electrical waveform of heater activation for drop formation is shown schematically in FIG. 2(*c*) and starts with optional beater activation pre-pulse 25, followed, after delay 55, by a first actuation pulse 30. Subsequent activation pulses 35, 40 and 45 of identical energy as pulse 30 follow, separated by delay times 60, 65 and 70, respectively. Each of these subsequent activation pulses creates one small drop. Heater "ON" times for the droplet-creating activation pulses 30, 35, 40 and 45 are substantially equal, as are delay times 60, 65, and 70. Delays 60, 65 and 70 are chosen to be less than delay 75, preferably less by a factor of 4 or more. The activation of heater 3 according to this waveform, during one pixel interval $P_3$, forms four drops, three smaller printing drops 110 and a larger non-printing drop 100 as shown schematically in FIG. 2(*d*).

Selectively, either heater activation waveform curve (a) or curve (c) is issued according to controller 13 according to whether printing or non-printing drops are required in accordance with image data. While three printing drops per image pixel time $P_3$ is shown here for simplicity of illustration, it must be understood that the same method may be logically extended to give fewer or larger counts of printing drops during the image pixel time interval $P_n$.

In the example presented here, and referring again to FIGS. 2(*a*) and 2(*c*), electrical activation pulses 25, 30, 35, 40 and 45 are 0.15, 0.30, 0.30, 0.30 and 0.30 microseconds in duration respectively. Delay times 55, 60, 65 and 70 are 1.0, 2.5, 2.5 and 2.5 microseconds, respectively. Time delay 75 is chosen to be long relative to delays 55, 60, 65 and 70, for example 20 to 500 microseconds, so that the volume ratio of large, printing drops to small non-printing drops will be preferentially a factor of 4 or greater.

Figure 3A:
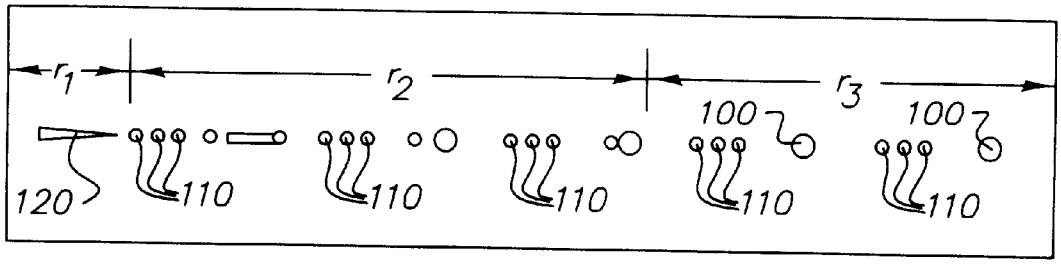
FIGS. 3(*a*)–3(*c*) shows captured images of jet break-off and drop formation as a result of the applied electrical waveforms of heater activation in accordance the prior art and the current invention.
Figure 3B:
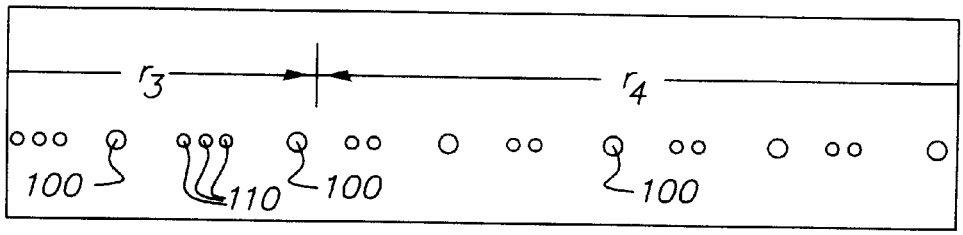
Figure 3C:
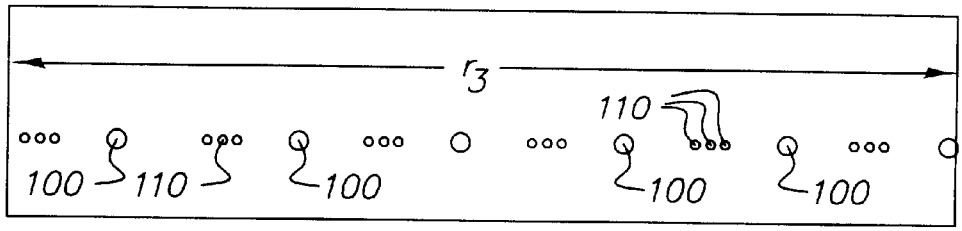

The problem of unintended coalescence of "printing" with other "printing" or "non-printing" droplets, associated with the prior art, is introduced by referring to reproductions of photographic images of a jet, captured with stroboscopic illumination, shown in FIG. 3. Four regions $r_1$–$r_4$ of drop formation and propagation are identified for the purpose of explanation. Referring to FIG. 3(*a*), heater 3 is activated in accordance with the waveform of FIG. 2(*c*). A jet of ink fluid

120 moving at 14 m/sec is shown in region $r_1$. Breakup of the jet occurs approximately 0.5 mm from the printhead (not shown at the left). Region $r_2$ consists of groups of droplets, some of which coalesce in flight, to create the larger drops 100. At the end of region $r_2$, droplet coalescence is complete to the point of producing one large drop and three small drops per image pixel time $P_3$ (25 microseconds in this example). The next region is designated as $r_3$, in which drop formation is complete and "printing" and "non-printing" droplets coexist without merging. In this region, the corresponding segment of the captured image is now similar to the drop formation shown schematically in FIG. 2(*d*). FIG. 3(*b*) is a view of the droplet stream at yet a further distance from the printhead. In region $r_4$ two of the small, printing drops 110 have merged, which is an example of the problem to be addressed by the current invention.

The foremost element of the invention described here involves the modification of the electrical waveforms used for heater 3 activation. Referring again to the waveform of FIG. 2(*c*), the energy in subsequent activation pulses 35, 40, and 45 is substantially greater than that of pre-pulses 25 and the first activation pulse 30, by either increasing the pulse amplitude or the pulse width (or both). The phrase "substantially greater than" is intended to mean increased by at least about 5%. It is anticipated that the present invention will work well n a range from less than 5% to at least 300% increase in energy between the initial actuation pulse and subsequent activation pulses. However, experimentation may show that energy increases outside of this range provide the benefits of the present invention, and therefore should be considered to by within the meaning of the phrase "substantially greater than." It is further believed that substantial improved will result in the range from about 10% to about 100% increase in energy. The concomitant effect is that the distance for over which small, printing droplets 110 remain independent of each other (as designated by the region $r_3$) is significantly increased. The improvement is reflected in the captured view of droplets in FIG. 3(*c*) at the same distance from the printhead as in FIG. 3(*b*). In the example of the improvement presented here, and referring again to FIGS. 2(*a*) and 2(*c*), electrical pulses 25, 30, 35, 40 and 45 are adjusted to 0.15, 0.30, 0.50, 0.50 and 0.50 microseconds in duration respectively. Delay times 55, 60, 65 and 70 are 1.0, 2.3, 2.3 and 2.3 microseconds, respectively.

Figure 4:
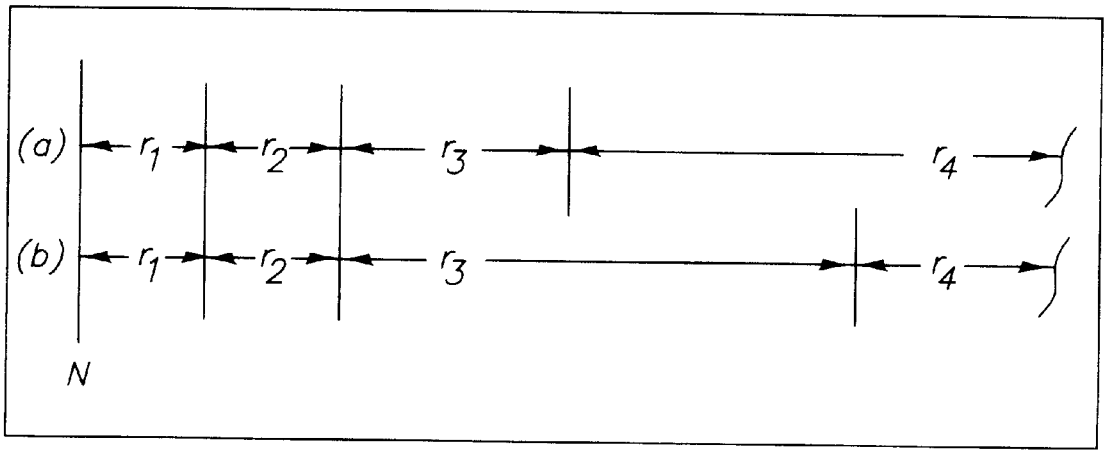
FIG. 4 is a schematic view of the improvement in the range over which drops are stable for the preferred embodiment of the present invention.

The advantage of this invention in the design and operation of a printing apparatus is reflected in the diagram of FIG. 4. Trace (*a*) represents the operation without the present invention while trace (b) represents the described improvement regarding the modification of relative pulse energies of heater 3 activation. Both traces (a) and (b) show the relative distances of the regions of drop formation from the surface N of the printhead 17. Region r, consists of a continuous column of fluid jetting from nozzle 7. Region $r_2$ represents a drop-formation regime in which droplet coalescence is not yet complete. Region $r_3$ contains (intentionally) coalesced droplets which have the desired volumes in accordance with printing and non-printing image data. It is in this region (or a portion thereof) where the separation means provided by gas flow is to be applied. In region $r_4$, coalescence of printing and/or non-printing drops can occur. For example, referring to FIG. 3(*b*), the first printing drop 110 may merge with the second printing drop 110, thereby doubling the drop volume of the resultant drop. Thus, it is undesirable to apply a separation force which discriminates based upon drop volume in regions other than $r_3$. In the case of the example discussed previously that does not incorporate the present invention, for trace (a) in FIG. 4, the lengths of regions $r_1$, $r_2$ and $r_3$ are 0.57, 0.64 and 1.6 mm respectively. For trace (b) of FIG. 4, the lengths are 0.57, 0.64 and 4.3 mm respectively. Clearly, the region $r_3$ has enlarged out away from printhead surface N by 2.7 mm as indicated in trace (a), as compared to trace (b). This allows a longer distance over which the gas flow separation force can interact with the droplet stream, thus resulting in a more accurate placement of ink drops onto the image receiver and consequently improved image quality.

Figure 5:
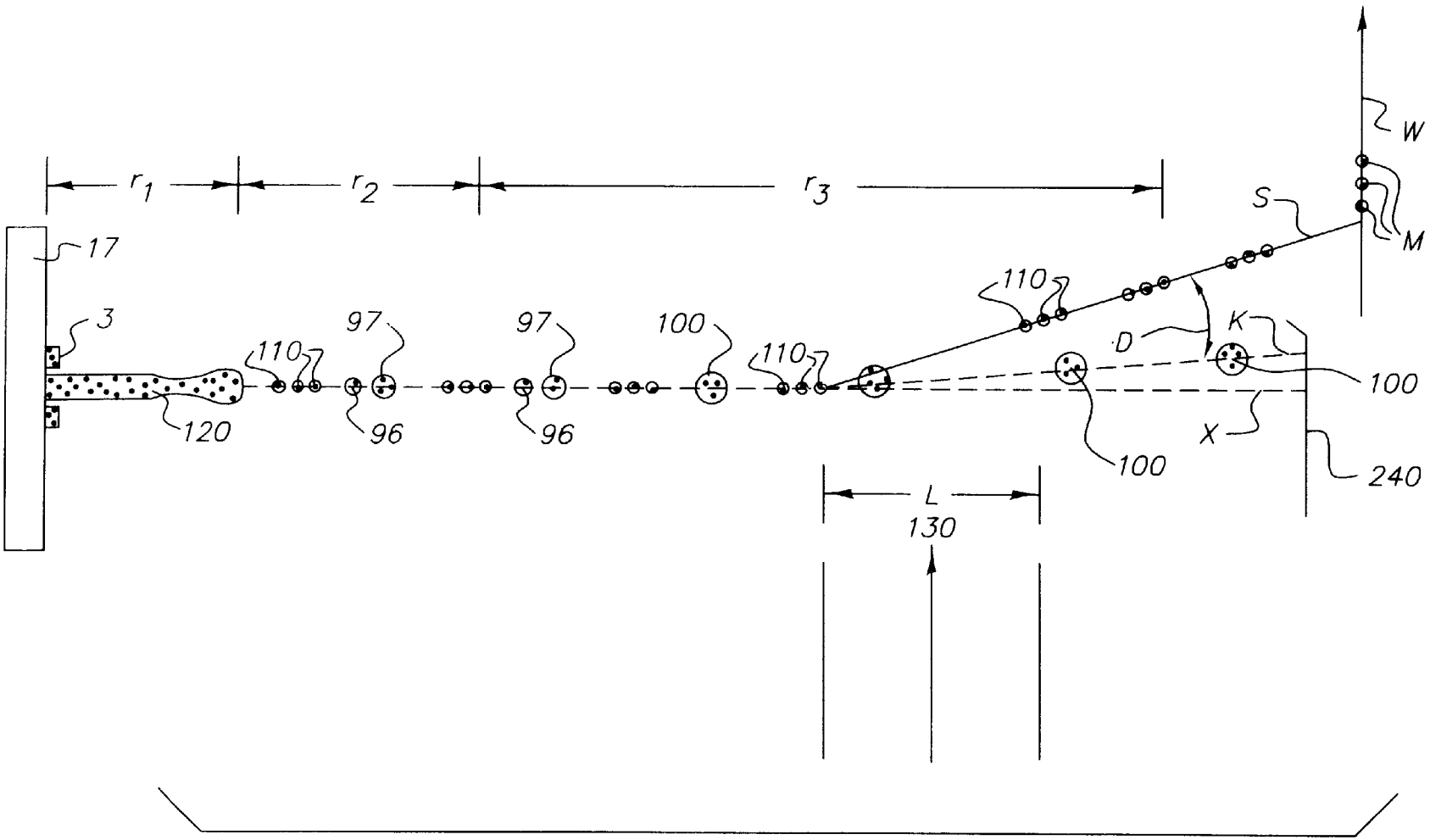
FIG. 5 is a schematic view of the jetting of ink from nozzle groups in a printhead made in accordance with the preferred embodiment of the present invention, wherein a force provided by a gas flow separates a plurality of drop volumes into printing and non-printing paths.

The operation of printhead 17 in a manner such as to provide an 110 image-wise modulation of drop volumes, as described above, is coupled with a discrimination means which separates droplets into printing or non-printing paths according to drop volume. Referring to FIG. 5, ink is ejected through nozzle 7 in printhead 17, creating a filament of working fluid 120 moving substantially perpendicular to printhead 17 along axis X. Heater 3 is selectively activated at various frequencies according to image data, causing filament of working fluid 120 to break up into a stream of individual ink droplets. Coalescence of drops 96 and drops 97 occurs to form non-printing drop 100, so at the distance from the printhead 17 that the discrimination means is applied, droplets are substantially in two size classes: small, printing drops 110 and large, non-printing drops 100. In the preferred implementation, the discrimination is effected by a force 130 provided by a gas flow perpendicular to axis X. The force 130 acts over distance L, which is less than or equal to distance $r_3$. Large, non-printing drops 100 have a greater mass and more momentum than small volume drops 110. As gas force 130 interacts with the stream of ink droplets, the individual ink droplets separate depending on each droplets volume and mass. Accordingly, the gas flow rate can be adjusted to provide sufficient differentiation D between the small droplet path S and the large droplet path K, permitting small printing drops 110 to strike print media W while large, non-printing drops 100 are captured by a ink guttering structure 240 described in the apparatus below.

An amount of separation D between the large, non-printing drops 100 and the small, printing drops 110 will not only depend on their relative size but also the velocity, density, and viscosity of the gas flow producing force 130; the velocity and density of the large, non-printing drops 100 and small, printing drops 110; and the interaction distance (shown as L in FIG. 5) over which the large, non-printing drop 100 and the small, printing drops 110 interact with the gas flow. Gases, including air, nitrogen, etc., having different densities and viscosities can also be used with similar results.

Large, printing drops 100 and small, non-printing drops 110 can be of any appropriate relative size. However, the droplet size is primarily determined by ink flow rate through nozzle 7 and the frequency at which heater 3 is cycled. The flow rate is primarily determined by the geometric properties of nozzle 7 such as nozzle diameter and length, pressure applied to the ink, and the fluidic properties of the ink such as ink viscosity, density, and surface tension. Although a wide range of droplet sizes are possible, in the example provided here, for a 10 micron diameter nozzle, large, non-printing drops 100 are 16 picoliters in volume, while small, printing droplets are 4 picoliters in volume.

Figure 6:
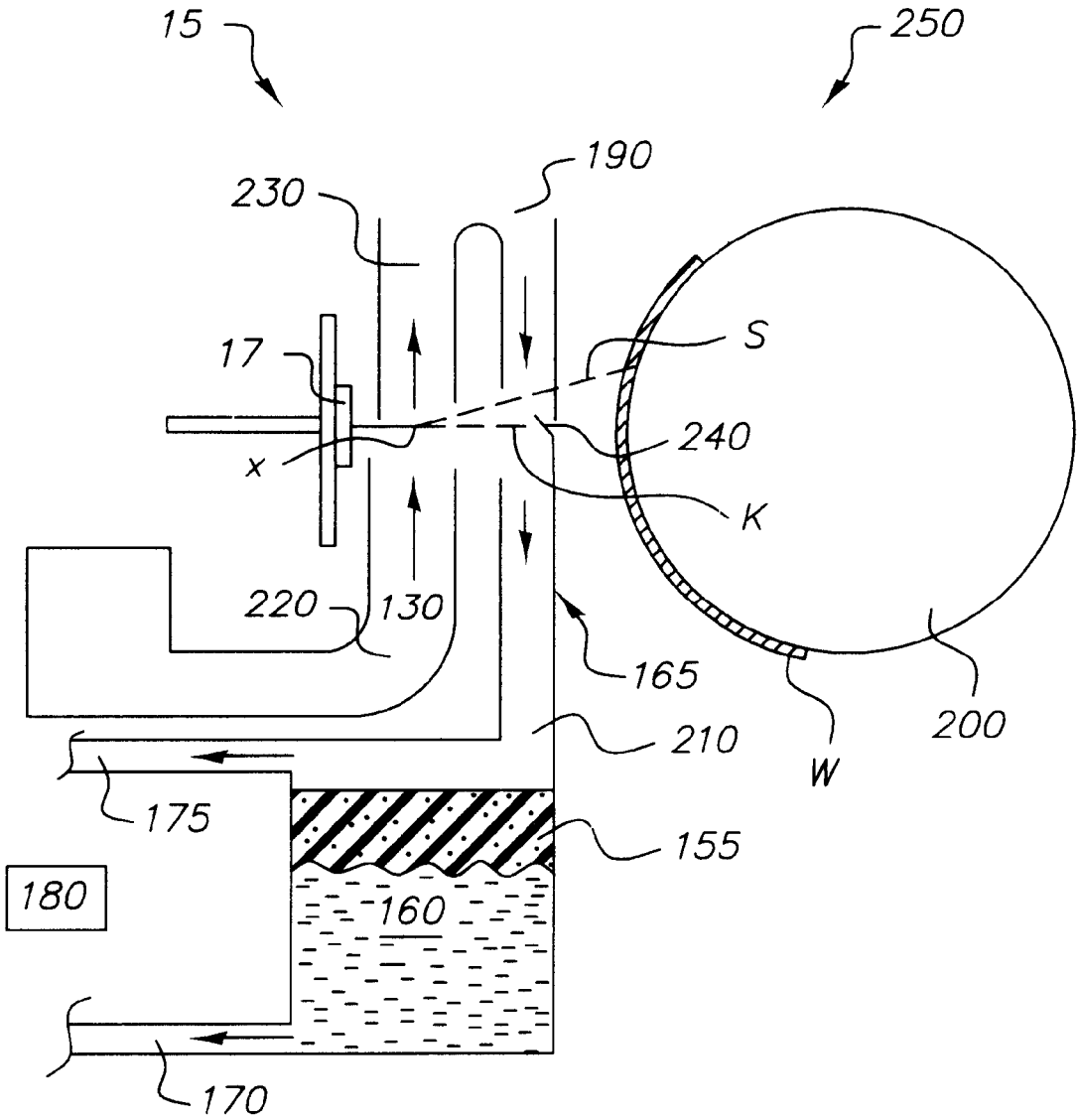
FIG. 6 is an inkjet printing apparatus made in accordance with the preferred embodiment of the present invention.

Referring to FIG. 6, a printing apparatus 250 (typically, an ink jet printer or printhead) made in accordance with the present invention is shown. Large volume ink drops 100 and small volume ink drops 110 are ejected from printhead 17 substantially along ejection path X in a stream. A droplet deflector 220 applies a force (shown generally at 130) to ink drops 100 and 110 as ink drops 100 and 110 travel along path X. Force 130 interacts with ink drops 100 and 110 along path X, causing the ink droplets 100 and 110 to alter course. As ink drops 100 have different volumes and masses from ink drops 110, force 130 causes small droplets 110 to separate from large droplets 100 with small droplets 110 diverging from path X along small droplet path S. Large droplets 100 are affected to a lesser extent by force 130 and travel along path K.

Upper plenum 230 is disposed opposite the end of droplet deflector 220 and promotes laminar gas flow while protecting the droplet stream moving along path X from external air disturbances. An ink recovery conduit 210 contains a ink guttering structure 240 whose purpose is to intercept the path K of large drops 100, while allowing small ink drops traveling along small droplet path S to continue on to the recording media W carried by print drum 200. Ink recovery conduit 210 communicates with ink recovery reservoir 160 to facilitate recovery of non-printed ink droplets by an ink return line 170 for subsequent reuse. Ink recovery reservoir contains open-cell sponge or foam 155 which prevents ink sloshing in applications where the printhead 17 is rapidly scanned. A vacuum conduit 175, coupled to a negative pressure source can communicate with ink recovery reservoir 160 to create a negative pressure in ink recovery conduit 210 improving ink droplet separation and ink droplet removal. The gas flow rate in ink recovery conduit 210, however, is chosen so as to not significantly perturb small droplet path S. Additionally, a plenum 190 provides a source for the air which is drawn into ink recovery conduit 210. In a preferred implementation, the gas pressure in droplet deflector 220 and in plenum 230 are adjusted in combination with the design of ink recovery conduit 210 and plenum 190 so that the gas pressure in the print head assembly near ink guttering structure 240 is positive with respect to the ambient air pressure near print drum 200. Environmental dust and paper fibers are thusly discouraged from approaching and adhering to ink guttering structure 240 and are additionally excluded from entering ink recovery conduit 210.

In operation, a recording media W is transported in a direction transverse to axis x by print drum 200 in a known manner. Transport of recording media W is coordinated with movement of print mechanism 15 and/or movement of printhead 17. This can be accomplished using controller 13 in a known manner. Print media W can be of any type and in any form. For example, the print media can be in the form of a web or a sheet. Additionally, print media W can be composed from a wide variety of materials including paper, vinyl, cloth, other large fibrous materials, etc. Any mechanism can be used for moving the printhead assembly 15 relative to the media, such as a conventional raster scan mechanism, etc.

Printhead 17 can be formed using a silicon substrate 6, etc. Printhead 17 can be of any size and components thereof can have various relative dimensions. Heater 3, electrical contact pad 11, and conductor 18 can be formed and patterned through vapor deposition and lithography techniques, etc. Heater 3 can include heating elements of any shape and type, such as resistive heaters, radiation heaters, convection heaters, chemical reaction heaters (endothermic or exothermic), etc. The invention can be controlled in any appropriate manner. As such, controller 13 can be of any type, including a microprocessor based device having a predetermined program, etc.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. An apparatus for producing a stream of fluid droplets of at least two types, the droplets of one of the types being of greater fluid volume than the droplets of the other type; said apparatus comprising:

a droplet forming mechanism actuatable by a series of energy pulses to create a series of one or more droplets, a first of the droplets of each series being of said one type, and any droplets subsequent to the first of the droplets of each series being of said other type; and a controller adapted to apply said series of energy pulses to said droplet forming mechanism such that a pulse associated with droplets of said one type has a predetermined energy and pulses associated with the droplets of said other type have energy substantially greater than said predetermined energy.

2. An apparatus as set forth in claim 1 wherein the energy of the pulses associated with droplets of said other type is at least about 5% greater than said predetermined energy.

3. An apparatus as set forth in claim 1 wherein the energy of the pulses associated with droplets of said other type is between about 5% and about 300% greater than said predetermined energy.

4. An apparatus as set forth in claim 1 wherein the energy of the pulses associated with droplets of said other type is between about 10% and about 100% greater than said predetermined energy.

5. An apparatus for printing an image, said apparatus comprising:

a printhead with at least one nozzle;

an ink droplet forming mechanism operable by a series of energy pulses to selectively create a series of one or more droplets, a first of the droplets of each series being of said one type, and any droplets subsequent to the first of the droplets of each series being of said other type; and a controller adapted to apply said series of energy pulses to said droplet forming mechanism such that a pulse associated with droplets of said one type has a predetermined energy and pulses associated with the droplets of said other type have energy substantially greater than said predetermined energy.

6. An apparatus as set forth in claim 5 wherein the energy of the pulses associated with droplets of said other type is at least about 5% greater than said predetermined energy.

7. An apparatus as set forth in claim 5 wherein the energy of the pulses associated with droplets of said other type is between about 5% and about 300% greater than said predetermined energy.

8. An apparatus as set forth in claim 5 wherein the energy of the pulses associated with droplets of said other type is between about 10% and about 100% greater than said predetermined energy.

9. An apparatus as set forth in claim 5 wherein the ink droplet forming mechanism comprises a heater in proximate location to each of said at least one nozzle.

10. An apparatus as set forth in claim 5 further comprising a droplet deflector including a gas flow generator positioned at an angle with respect to said stream of ink droplets, said gas flow generator being operable to interact with said stream of ink droplets such as to separate ink droplets of said one type from ink of said other type.

11. An apparatus for producing a stream of fluid droplets within two groups, the droplets of one of the groups being of greater fluid volume than the droplets of the other of the groups; said apparatus comprising:

a droplet forming mechanism actuatable by a series of energy pulses to create a series of droplets, a first of the droplets of a series being within said one group, and droplets subsequent to the first of the droplets being within said other of the groups; and a controller adapted to apply said series of energy pulses to said droplet forming mechanism such that a pulse associated with the first of the droplets of a series has a predetermined energy and pulses associated with the droplets subsequent to the first of the droplets have energy substantially greater than said predetermined energy.

12. A method for producing a stream of fluid droplets from a droplet forming mechanism actuatable by a series of energy pulses to create a series of one or more droplets; said method comprising:

producing a series of energy pulses wherein the first pulse of the series has a predetermined energy and pulses subsequent to the first pulse of the series have energy substantially greater than said predetermined energy;

applying the series of energy pulses to the droplet forming mechanism to create a series of one or more droplets, wherein droplets associated with the first pulse of each series are of greater fluid volume than droplets associated with pulses subsequent to the first pulse of the series.

13. A method as set forth in claim 12 wherein the energy of the pulses subsequent to the first pulse of the series is at least about 5% greater than said predetermined energy.

14. A method as set forth in claim 12 wherein the energy of the pulses subsequent to the first pulse of the series is between about 5% and about 300% greater than said predetermined energy.

15. A method as set forth in claim 12 wherein the energy of the pulses associated with droplets of said other type is between about 10% and about 100% greater than said predetermined energy.

* * * * *